US007248825B2

(12) United States Patent
Nishitani et al.

(10) Patent No.: US 7,248,825 B2
(45) Date of Patent: Jul. 24, 2007

(54) DEVELOPER REPLENISHING APPARATUS

(75) Inventors: Hitoshi Nishitani, Tokyo (JP); Teruaki Tsurusaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/258,932

(22) Filed: Oct. 27, 2005

(65) Prior Publication Data

US 2006/0104670 A1 May 18, 2006

(30) Foreign Application Priority Data

Nov. 12, 2004 (JP) ..... 2004-329460

(51) Int. Cl.
*G03G 15/08* (2006.01)

(52) U.S. Cl. ..... 399/258; 399/254; 399/255; 399/263

(58) Field of Classification Search ..... 399/254, 399/255, 256, 258, 259, 260, 261, 262, 263, 399/53
See application file for complete search history.

(56) References Cited

U.S. PATENT DOCUMENTS

| | | | | |
|---|---|---|---|---|
| 4,937,625 | A * | 6/1990 | Kato et al. | 399/258 |
| 5,045,884 | A * | 9/1991 | Ohira et al. | 399/262 |
| 5,652,947 | A * | 7/1997 | Izumizaki | 399/258 |
| 5,950,055 | A * | 9/1999 | Yahata et al. | 399/258 |
| 6,324,370 | B1 * | 11/2001 | Isobe et al. | 399/258 |
| 6,456,809 | B1 * | 9/2002 | Sekiguchi | 399/254 |
| 6,510,291 | B2 * | 1/2003 | Campbell et al. | 399/260 |
| 6,625,404 | B2 * | 9/2003 | Watanabe et al. | 399/262 |
| 6,819,883 | B2 * | 11/2004 | Nakase et al. | 399/258 |
| 6,882,817 | B2 * | 4/2005 | Kita | 399/258 |
| 7,046,945 | B2 | 5/2006 | Nishitani et al. | 399/254 |
| 7,110,707 | B2 | 9/2006 | Nishitani | 399/258 |
| 7,127,207 | B2 | 10/2006 | Tsurusaki | 399/359 |
| 2002/0009309 | A1 * | 1/2002 | Suzuki | 399/254 |
| 2003/0072590 | A1 * | 4/2003 | Shimaoka et al. | 399/258 |
| 2003/0152394 | A1 * | 8/2003 | Nakase et al. | 399/258 |
| 2005/0002700 | A1 * | 1/2005 | Nishitani | 399/258 |
| 2005/0117920 | A1 * | 6/2005 | Ogata et al. | 399/254 |
| 2006/0104658 | A1 | 5/2006 | Tsurusaki | 399/98 |
| 2006/0104670 | A1 | 5/2006 | Nishitani et al. | 399/258 |
| 2006/0165423 | A1 | 7/2006 | Nishitani et al. | 399/27 |

FOREIGN PATENT DOCUMENTS

JP 2000-267419 9/2000

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

A developer replenishing apparatus including a first developer container for containing a developer to be replenished to a developing apparatus, a second developer container for containing the developer to be replenished to the first developer container, a first replenishing mechanism for replenishing the developer in the first developer container to the developing apparatus, a second replenishing mechanism for replenishing the developer in the second developer container to the first developer container, a driving source capable of simultaneously driving the first replenishing mechanism and the second replenishing mechanism wherein, at an operated state of the driving source, a replenishing amount of the developer per unit time from the second developer container to the first developer container is larger than a replenishing amount of the developer per unit time from the first developer container to the developing apparatus.

5 Claims, 10 Drawing Sheets

DEVELOPER REPLENISHING APPARATUS

BACKGROUND OF THE INVENTION

1. Field of the Invention

The present invention relates to a developer replenishing apparatus for replenishing a developer replenisher to a developing apparatus for use in a copying apparatus, a facsimile apparatus, a printer or the like for developing an electrostatic image, formed on an image bearing member by an electrophotographic process or an electrostatic recording process with a developer thereby obtaining a visible image.

2. Related Background Art

In an image forming apparatus such as a copying apparatus, a facsimile apparatus, a printer or the like, there is well known a method of developing an electrostatic latent image by supporting a dry developer as an image developer material on a surface of a developer carrying member, carrying and supply the developer to the vicinity of a surface of an image bearing member which bears an electrostatic latent image and developing the electrostatic latent image under an application of an alternating (AC) electric field between the image bearing member and the developer carrying member, thereby obtaining a visible image, and, it is common to employ a developing sleeve as the developer carrying member and a photosensitive drum as the image bearing member.

For such image development, there is for example known so-called magnetic brush developing method which employs a developer of a two-component composition (so-called two-component developer) containing toner particles and carrier particles, to form a magnetic brush on the surface of a developing sleeve provided therein with a magnet, positions such magnetic brush in sliding contact with or in a close relationship to a photosensitive drum opposed across a small developing gap and continuously applies an AC electric field across a gap between the developing sleeve and the photosensitive drum (S-D gap) thereby repeating a transition of the toner particles from the developing sleeve side to the photosensitive drum side and a reverse transition thereof to achieve a development.

For example in an image forming apparatus utilizing the aforementioned two-component developer, as the toner is consumed with the progress of image formation, it is necessary to replenish the toner into the developing apparatus.

In the following there will be explained a configuration of a developing apparatus for two-component magnetic brush development and a developer replenishing apparatus for replenishing the developer into the developing apparatus, with reference to FIGS. 7A and 7B, which are a schematic cross-sectional views of the developing apparatus and the developer replenishing apparatus.

A developing apparatus 4 is provided, in a developer container (main body of the developing apparatus) 41, with a developing sleeve 46 as a developer carrying member, a magnet roller 47 as magnetic field generating means fixed inside the developing sleeve 46, a developing screw 44 and an agitating screw 45 serving as developer agitating means which agitates and carries the developer in the developer container 41, a toner receiving aperture 49, and a regulation blade 48 provided for forming a thin layer of the developer on the surface of the developing sleeve 46.

An interior of the developing container 41 is divided into a developing chamber 42 and an agitating chamber 43. The developing screw 44 is provided in the developing chamber 42, and the agitating screw 45 is provided in the agitating chamber 43. As shown in the illustration, the developing sleeve 46 is positioned close to the photosensitive drum 1, and is rotated in the same or opposite direction to the photosensitive drum 1, thereby executing a development in a state where the developer (hatched portion in the drawing) is in contact with the photosensitive drum 1.

A developer replenishing apparatus 50 is provided with a toner sub-container 51 for storing replenishing developer (toner) to be replenished to the developing apparatus 4. Above the toner sub-container 51, there is provided a toner supply aperture 60 capable of receiving a toner supply.

Also under the toner sub-container 51, a toner carrying pipe 52, capable of carrying the toner from the toner sub-container 51, is provided in a cylindrical shape protruding substantially horizontally. In the toner carrying pipe 52, a replenishing screw (first replenishing means) 53, having a spiral fin on a rotary axis, is provided in rotatable manner. The replenishing screw 53 is connected to drive means 54 which rotates the replenishing screw 53.

The toner sub-container 51 is also provided with a toner sensor (toner presence/absence detection sensor) 56 for directly detecting presence/absence of the toner by an optical method. Further, the toner sub-container 51 is also provided therein with an agitating member 55 capable of a rotating or reciprocating motion.

The developer replenishing apparatus 50 further includes a main toner container (second developer container) 57, provided above the toner sub-container 51, for storing the toner to be replenished to the toner sub-container 51. The main toner container 57 is provided therein with an agitating/carrying member (second replenishing means) 58 in rotatable manner, which is connected to drive means 59 which rotates the agitating/carrying member 58.

The main toner container 57 may be rendered detachable from the toner sub-container 51 and the main body of the image forming apparatus, and, in such case, it is called a toner cartridge (or toner bottle).

In the following, there will be explained an image forming operation in the developing apparatus.

The developing container 41 contains a two-component developer formed by a mixture of non-magnetic toner particles (toner) and magnetic carrier particles (carrier). A toner/carrier mixing ratio (hereinafter called T/C ratio) is maintained constant by a toner replenishment by an amount of the toner consumed in image development. More specifically, the toner is dropped, by the replenishing screw 53 from the toner sub-container 51 containing the replenishing toner, into the agitating chamber 43 provided with the agitating screw 45 through the receiving aperture 49 of the developing container 41 and thus replenished to the developing apparatus 4. For detecting and maintaining the T/C ratio of the developer in the developing container 41, there have been employed various methods.

In the following, there will be explained a toner replenishing operation into the toner sub-container 51 in case the toner therein decreases by toner consumption.

The agitating member 55 has a function of disintegrating toner by a rotating or reciprocating motion, in order to avoid toner blockage in the toner sub-container 51. Also the replenishing screw 53 is provided for executing a function of carrying the toner in the toner sub-container 51 in a longitudinal direction (direction parallel with the plane of drawing) toward the aperture 49 communicating with the developing container 41, and a function of extruding and dropping the toner from the aperture onto the developing container 41.

In case, after the detection of absence of toner by the toner sensor, a toner absent state continues even after the operation of the agitating member 55, it is judged that the toner is not solidified in a part of the toner sub-container 51 but the toner is really used up.

When the absence of toner in the toner container 51 is identified, the agitating/carrying member 58 in the main toner container 57 rotates to replenish the toner from the main toner container 57 to the toner sub-container 51. The agitating/carrying member 58 is provided for a function of disintegrating the toner by rotation thereby preventing blockage of the toner in the main toner container 57, a function of carrying the toner in the main toner container 57 in the longitudinal direction (parallel with the plane of drawing) toward the toner supply aperture 60 communicating with the toner sub-container 51, and a function of extruding and dropping the toner from the supply aperture 60 into the toner sub-container 51, and is generally constituted of a sheet material such as of PET.

The rotation of the agitating/carrying member 58 of the main toner container 57 is continued until the toner 56 detects presence of toner, and, thereafter, the toner replenishment is executed in succession from the toner sub-container 51 through the replenishing screw 53.

In the foregoing description, the agitating/carrying member 58 is assumed to start rotation after the toner sensor 56 detects a toner absent state, but the agitating/carrying member 58, being formed by a sheet material and not unnecessarily forcing the toner into the toner sub-container 51, may also be rotated even before the detection of the toner absent state.

Also in case the toner sensor 56 does not detect a toner present state even after a sufficiently long rotation of the agitating/carrying member 58 of the main toner container 57, it can be judged that the toner is replenished into the toner sub-container 51, namely that the toner is absent also in the main toner container 57, whereupon the toner absent state is informed to the user by display means such as an operation panel.

The main toner container 57 may be constructed to be detachable from the apparatus or fixed to the apparatus. In case of the detachable construction, the main toner container 57 is generally called a toner cartridge, and, when the toner is exhausted, the toner replenishment is achieved by replacing the entire main toner container 57. Also the fixed construction, the toner is directly replenished to the main toner container 57 from another toner container.

The replenishing screw 53 is rotated by the drive means 54, with a number of rotations (rotation frequency) or a rotation time selected according to a toner amount required by the developing apparatus, and the rotation is stopped when the number of rotations or the rotation time thus selected is reached, whereby the toner in an amount requested by the developing apparatus is carried and replenished into the developing container. A toner carrying amount per a turn or per a unit time is determined in advance as a constant according to the size of the toner replenishing screw, so that there is enabled a control of calculating the number of rotations or the rotation time according to the requested amount.

Since a toner carrying amount by the screw is proportional to the number of rotations of the screw, a control by the rotation time assumes that the drive means for the screw is capable of always rotating the screw with a constant speed. On the other hand, a control by the number of rotations is possible, even when the rotation speed of the screw is not constant, by providing means which counts the number of rotations of the screw.

In FIGS. 7A and 7B, for the ease of understanding, the photosensitive drum 1 and the developing container 41 has a longitudinal direction perpendicular to the plane of the drawing while the toner sub-container 51, the replenishing screw 53 and the main toner container 57 has a longitudinal direction parallel with the plane of the drawing, but such longitudinal directions are usually provided in parallel.

In the following, there will be explained a driving mechanism for the developer replenishing apparatus 50.

FIG. 8 schematically shows the configuration of a driving mechanism 200 for the developing apparatus 4 and the developer replenishing apparatus 50, similar to that disclosed in Japanese Patent Application Laid-open No. 2000-267419.

As explained in the foregoing, the developing apparatus 4 is capable, by a developer contained therein, of developing an electrostatic image on the photosensitive drum 1 into a visible image. The developing apparatus 4 is provided with a developing screw 44 and an agitating screw 45 constituting developer agitating means which agitates and carries the developer in the developing apparatus 4. Also the developer replenishing apparatus 50 is provided, as described above, with a toner sub-container 51 constituting a first developer container for storing toner to be replenished to the developing apparatus 4, a replenishing screw 53 constituting first replenishing means for discharging the toner from the toner sub-container 51 and replenishing it to the developing apparatus 4, a main toner container 57 constituting a second developer container storing the toner to be replenished to the toner sub-container 51, and an agitating/carrying member 58 constituting second replenishing means for discharging the toner from the main toner container 57 and replenishing it to the toner sub-container 51.

The driving mechanism 200 for the developer replenishing apparatus 50 is provided with a motor 80 constituting rotation drive means which is capable of transmitting a driving power to the replenishing screw 53 and the agitating/carrying member 58, and a drive gear train 70 constituting rotation transmitting means which is capable of transmitting the rotation of the motor 80 to the replenishing screw 53 and the agitating/carrying member 58. The drive gear train 70 includes switch means which is capable of switching in at least two states, namely a first state capable of transmitting the rotation of the motor 80 to the replenishing screw 53 and a second state capable of transmitting it to the agitating/carrying member 58.

More specifically, the drive gear train 70 includes a first drive gear 73*a* at the side of the motor 80 and a second drive gear 73*b* engaging with the first drive gear 73*a*, and the second drive gear 73*b* selectively engages with a first intermediate gear 71 for transmitting the driving power to the replenishing screw 53 or with a second intermediate gear 72 for transmitting the driving power to the agitating/carrying member 58.

The first intermediate gear 71 transmits the driving power to a replenishing screw driving gear 54 constituting drive means for the replenishing gear 53, while the second intermediate gear 72 transmits the driving power to an agitating/carrying member driving gear 59 constituting drive means for the agitating/carrying member. The second gear 73*b* is rotatably supported by a lever 73*c*, rotatably articulated about the center of the first gear 73*a*. Also the motor 80 is rotatable in the forward and reverse directions, and control means 90 controls rotation of the motor 80 in the forward or reverse direction and stopping thereof.

In the aforementioned configuration, when the motor 80 is rotated in a direction A1 in FIG. 8, the lever 73*c* rotates in a direction A2 whereby the second drive gear 73*b* transmits the driving power to the first intermediate gear 71. On the other hand, when the motor 80 is rotated in a direction B1, the lever 73*c* rotates in a direction B2 whereby the second drive gear 73*b* transmits the driving power to the second intermediate gear 72. As a result, when the motor 80 rotates in the direction A1, the replenishing screw 53 rotates while the agitating/carrying member 58 is stopped. Also when the motor 80 rotates in the direction B1, the agitating/carrying member 58 rotates while the replenishing screw 53 is stopped.

In this manner, the drive gear train 70, owing to the presence of the lever 73*c*, can be switched to a first state capable of transmitting the rotation of the motor 80 to the replenishing screw 53 and a second state capable of transmitting the rotation of the motor 80 to the agitating/carrying member 58, by the switching of the rotating direction of the motor 80 by the control means 90.

In this example, as explained in the foregoing, the first drive gear 73*a*, the second drive gear 73*b*, the lever 73*c*, and the control means 90 which control the forward/reverse rotation of the motor 80 constitute switching means which is capable of switching between the first state and the second state mentioned above.

In the aforementioned configuration, in case of rotating the replenishing screw 53 for toner replenishing from the toner sub-container 51 to the developing apparatus 4, the motor 80 is rotated in the direction A1 whereby the replenishing screw 53 can be rotated while the agitating/carrying member 58 is stopped. Also in case of rotating the agitating/carrying member 58 for toner replenishing from the main toner container 57 to the toner sub-container 51, the motor 80 is rotated in the direction B1 whereby the agitating/carrying member 58 can be rotated while the replenishing screw 53 is stopped.

Thus a single motor can achieve the replenishing operation and the agitating operation thereby realizing simplification, compactization and cost reduction of the image forming apparatus, as described in Japanese Patent Application Laid-open No. 2000-267419.

FIG. 9 shows a driving layout of a developing apparatus 4 and a developer replenishing apparatus 50 in each image forming station P (PY, PM, PC, PK) in a four-unit tandem image forming apparatus 100. In each of the first, second, third and fourth colors, the developing apparatus 4, the developer replenishing apparatus 50 and the driving mechanism 200 (200Y, 200M, 200C, 200K) therefore have configurations which are the same as those shown in FIG. 8. A full-color printing is made possible by connecting the developing apparatuses 4 and the developer replenishing 50 of four colors as shown in FIG. 9.

In this system, images of respectively colors are superposed by a movement of an intermediate transfer member (intermediate transfer medium) 7 or a recording material (recording paper) in a direction indicated by an arrow, so that the image forming operations of the respective colors are respectively delayed by a time required by the intermediate transfer member 7 or the recording material to travel over a distance Q indicated in the drawing.

The photosensitive drum 1 (1Y, 1M, 1C, 1K) is rotated constantly as it is in contact with the recording paper or the intermediate transfer member, but the agitating screw and the developing screw as the developer agitating means in the developing apparatus 4 are usually rotated only during a necessary period within the image forming operation, in order to minimize the deterioration of the developer. However, a toner replenishing operation from the toner sub-container to the developing apparatus in a state where the agitating screw and the developing screw in the developing apparatus 4 are stopped may cause a stagnation of the replenished toner in the vicinity of the supply aperture, thereby causing a toner clogging or an uneven T/C ratio in the developing apparatus, so that the toner replenishing operation from the toner sub-container to the developing apparatus has to be conducted in a state where the agitating screw and the developing screw in the developing apparatus 4 are rotated.

FIG. 10 indicates a rotating period of the agitating screw and the developing screw in the developing apparatus, and T therein corresponds to a time of travel of the recording paper or the intermediate transfer medium over the distance Q shown in FIG. 9. Therefore, as shown in FIG. 10, while the agitating screw and the developing screw in the developing apparatus of each color are rotated, the corresponding motor rotates in the direction A1 to rotate the replenishing screw as the toner replenishing means in the developer replenishing apparatus thereby executing a toner replenishing operation from the toner sub-container to the developing apparatus, and the motor is rotated in the direction B1 suitably in other periods to execute an agitating operation.

SUMMARY OF THE INVENTION

In consideration of the foregoing, an object of the present invention is to provide a developer replenishing apparatus constituting an extension of the prior developer replenishing apparatus and capable of a stable developer replenishing operation while further simplifying the mechanism.

The aforementioned object can be attained, according to the present invention, by a developer replenishing apparatus for replenishing a replenishing developer to a developing apparatus for developing an electrostatic image, the replenishing apparatus including:

a first developer container for containing the replenishing developer to be replenished to the developing apparatus;

a second developer container for containing the replenishing developer to be replenished to the first developer container;

a first replenishing mechanism for replenishing the replenishing developer in the first developer container to the developing apparatus;

a second replenishing mechanism for replenishing the replenishing developer in the second developer container to the first developer container;

a driving source capable of simultaneously driving the first replenishing mechanism and the second replenishing mechanism;

wherein, at an operated state of the driving source, a replenishing amount of the replenishing developer per unit time from the second developer container to the first developer container is larger than a replenishing amount of the replenishing developer per unit time from the first developer container to the developing apparatus.

DETAILED DESCRIPTION OF THE PREFERRED EMBODIMENTS

Figure 1:
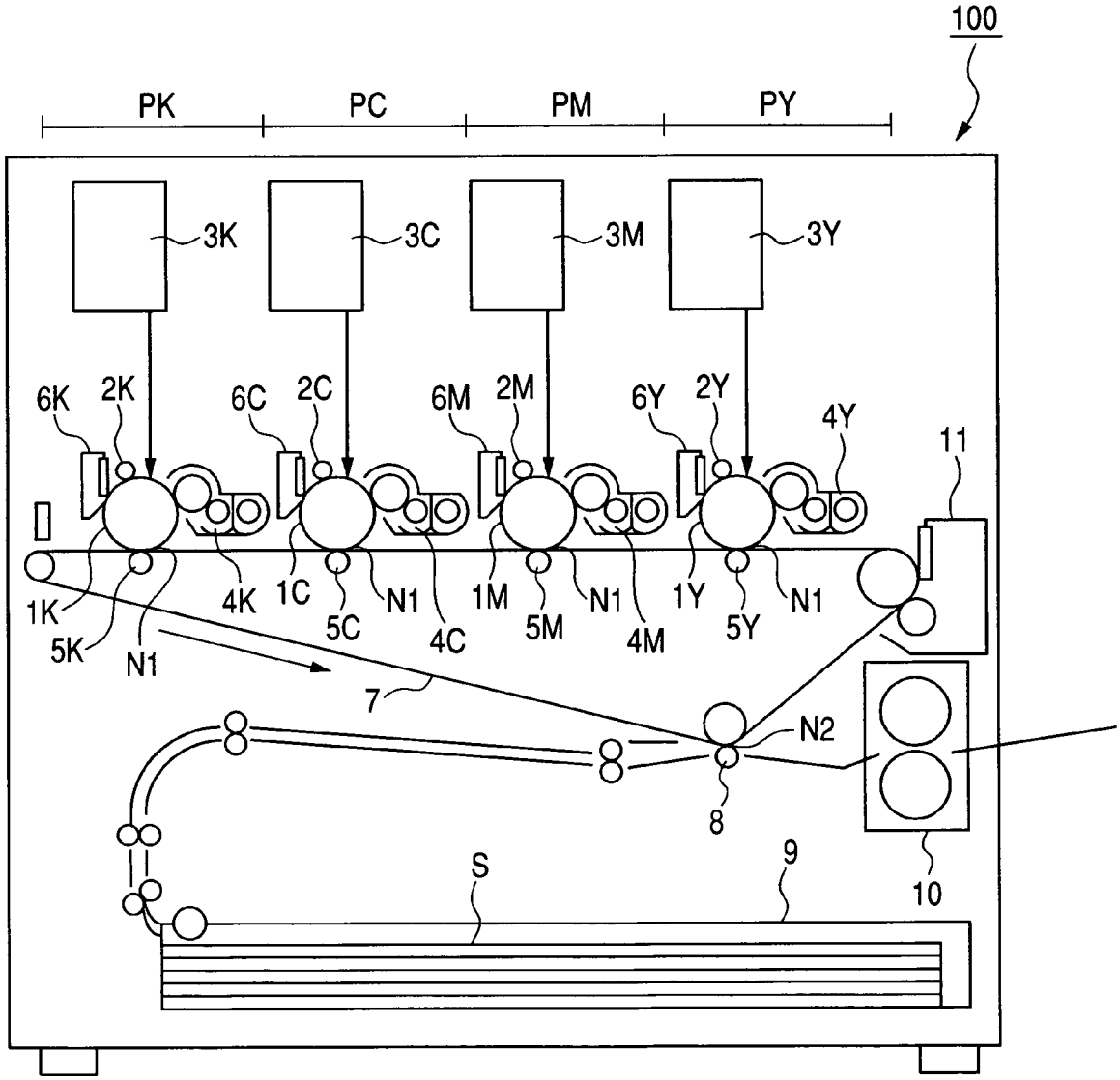
FIG. 1 is a schematic view showing a configuration of an embodiment of an image forming apparatus of the present invention.

In the following, an image forming apparatus of the present invention will be clarified in detail with reference to the accompanying drawings.

Embodiment 1

In the following, an image forming apparatus of the present invention will be explained by an embodiment, and, a developing apparatus and a developer replenishing apparatus employed in the present embodiment are same, in the configuration and the operation mode, as those of the prior art explained before in relation to FIGS. 7 to 10, so that the foregoing description is applicable thereto. In the following, therefore, there will be principally explained a driving configuration of the developer replenishing apparatus, featuring the present invention, in comparison with a prior configuration.

(Entire Configuration and Operation of Image Forming Apparatus)

At first, an embodiment of the image forming apparatus of the present invention will be explained about its entire configuration and operations with reference to FIG. 1. The image forming apparatus of the present embodiment is constituted by an electrophotographic color image forming apparatus.

An image forming apparatus 100 of the present embodiment is capable, according to image formation supplied from an original reading apparatus or a host equipment such as a personal computer communicably connected with a main body of the image forming apparatus, of forming a full-color image of four colors of yellow (Y), magenta (M), cyan (C) and black (K) on a recording material (recording paper, plastic sheet or cloth) by an electrophotographic process.

The image forming apparatus 100 of the present embodiment is a four-unit tandem image forming apparatus, equipped with first, second, third and fourth image forming stations P (PY, PM, PC, PK). The image forming apparatus 100 of the present embodiment employs an intermediate transfer method, in which an intermediate transfer belt 7, constituting an intermediate transfer member capable of circulating (rotating) displacement, moves in a direction indicated by an arrow to pass through the respective image forming stations P whereupon images of the respective colors are superposed on the intermediate transfer belt 7. Then the toner images of the respective colors thus superposed on the intermediate transfer belt 7 are transferred onto a recording material S to obtain a recorded image.

In the present embodiment, the image forming stations P (PY, PM, PC, PK) have a substantially same configuration except for a difference in the developing color, and will therefore be explained in collective manner without the suffix Y, M, C or K attached for indicating a specific image forming station unless a particular distinction is required.

Each image forming station P is provided with a drum-shaped electrophotographic photosensitive member (hereinafter called "photosensitive drum") 1 as an image bearing member. Along the external periphery of the photosensitive drum 1, there are provided a charging roller 2 serving as charging means, an exposure apparatus (laser exposure optical system in the present embodiment) 3 serving as exposure means, a developing apparatus 4 serving as developing means, and a cleaning apparatus 6 serving as cleaning means. Also a primary transfer roller 5 serving as primary transfer means is so provided as to be opposed to the photosensitive drum across an intermediate transfer belt 7.

At an image formation, the rotating photosensitive drum 1 is uniformly charged by the charging roller 2. Then the charged surface of the photosensitive drum 1 is scan exposed by the exposure apparatus 3 according to an image information signal, whereby an electrostatic image formed on the photosensitive drum 1. The electrostatic image formed on the photosensitive drum 1 is developed with a developer in the developing apparatus 4 as a toner image. The toner image formed on the photosensitive drum 1 is transferred, at a primary transfer portion (nip) N1 where the intermediate transfer belt 7 is in contact with the photosensitive drum 1, onto the intermediate transfer belt 7.

Figure 9:
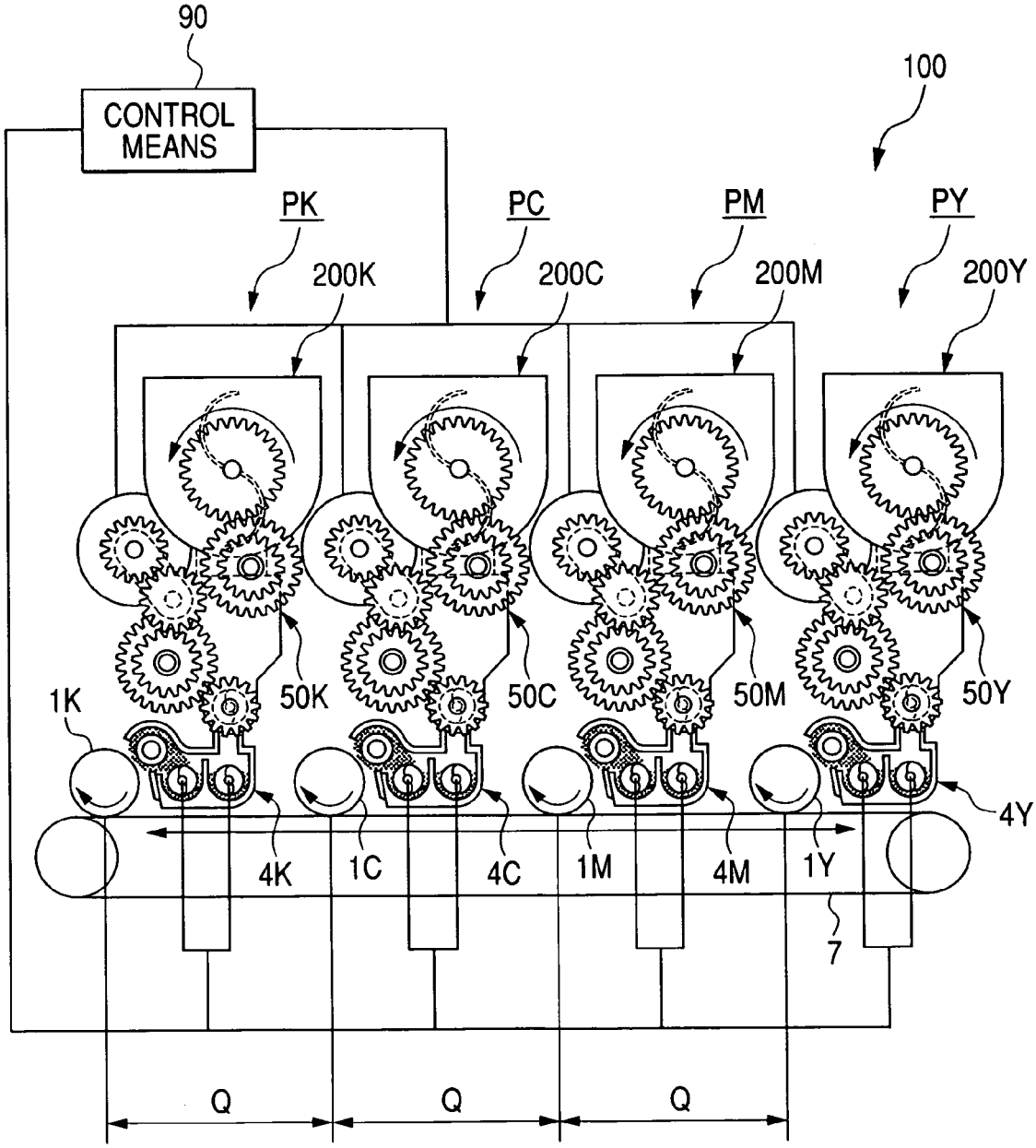
FIG. 9 is a view showing a schematic configuration of an image forming apparatus utilizing the driving mechanism for the developer replenishing apparatus and the developing apparatus shown in FIG. 8.
Figure 10:
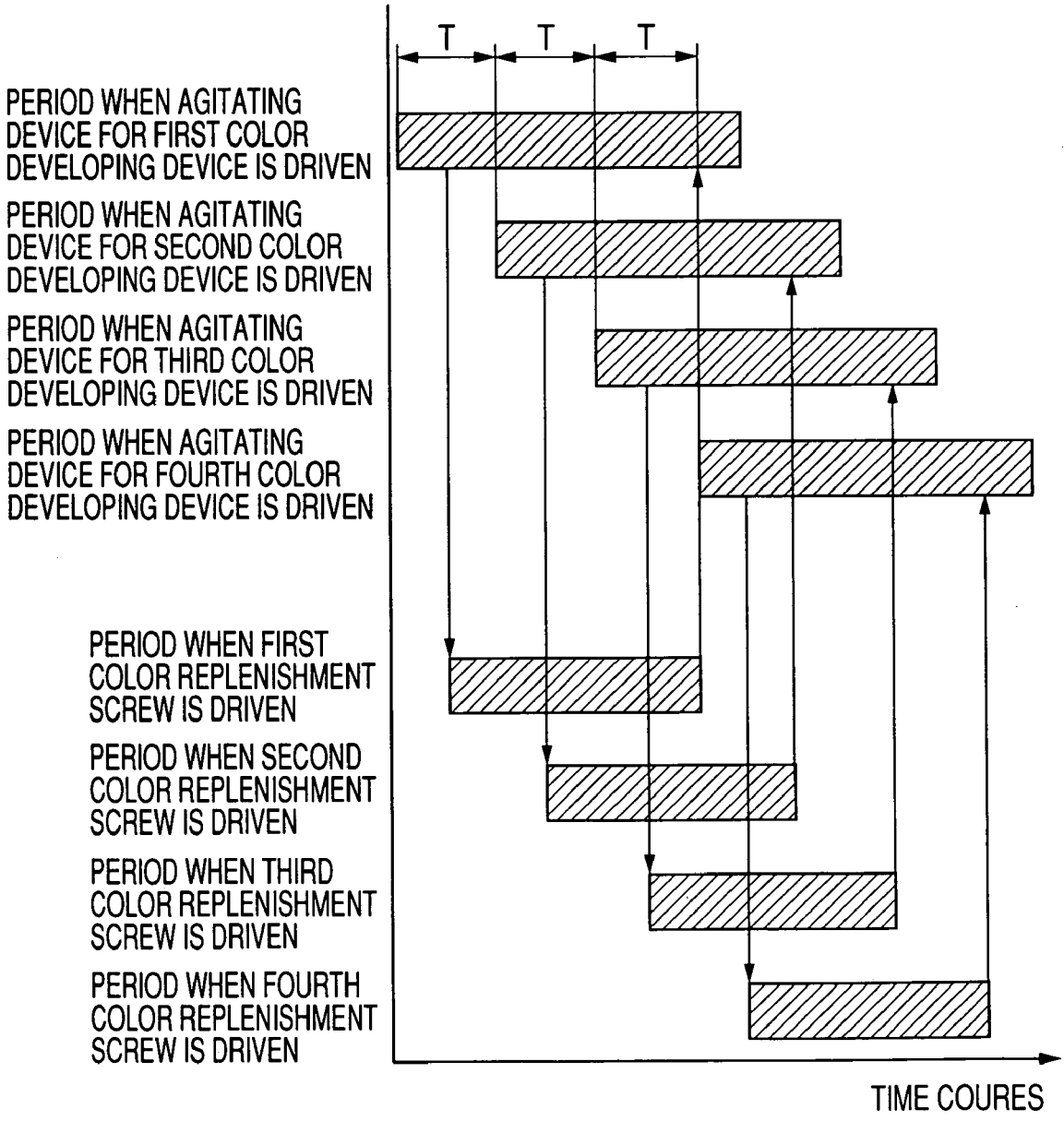
FIG. 10 is a chart showing timings of rotation and stopping of developer agitating means (agitating screw, developing screw) of the developing apparatus and of the replenishing screw of the developer replenishing apparatus.

In case of forming a four-colored full-color image, image forming operations are executed in the respective image forming stations with successive delays, starting from the first image forming station PY, by a time required by the intermediate transfer belt 7 to travel a distance Q between the photosensitive drums 1 (cf. FIG. 9). Thus, along with the displacement of the intermediate transfer belt 7, the toner images of respective colors are transferred in succession at the primary transfer portions N1 of the respective image forming stations P, thereby obtaining a superposed toner image formed by superposition of four toner images on the intermediate transfer belt 7.

On the other hand, a recording material S, contained for example in; a cassette 9 serving as a recording material container, is conveyed, by recording material conveying members such as a pickup roller, conveying rollers and registration rollers, to a secondary transfer portion (nip portion) N2 where the intermediate transfer belt 7 is in contact with a secondary transfer roller 8 serving as secondary transfer means, in synchronization with the toner image on the intermediate transfer belt 7.

Thus the superposed toner image on the intermediate transfer belt 7 is transferred at the secondary transfer portion N2 onto the recording material S. Thereafter the recording material S is separated from the intermediate transfer belt 7 and is conveyed to a fixing device 10, in which the recording material S is heated and pressed whereby the unfixed toner image thereon is fixed. Thereafter the recording material S is discharged to the exterior of the apparatus.

A deposit such as toner remaining on the photosensitive drum 1 after the primary transfer step is removed by the cleaning apparatus 6. Also a deposit such as toner remaining on the intermediate transfer belt 7 after the secondary transfer step is removed by an intermediate transfer member cleaner 11.

It is also possible to form a monochromatic or multi-color image, such as a monochromatic black image, by utilizing any one or plurality of the four image forming stations.

In the present embodiment, the image forming apparatus 100 is assumed to adopt an intermediate transfer method, but the present invention is not limited to such configuration. As already known to those skilled in the art, there is known an image forming apparatus equipped, instead of the intermediate transfer belt 7, with a recording material supporting member which supports and conveys a recording material to a nip portion with each photosensitive drum 1. In such configuration, the toner images of respective colors are transferred in superposition, at the respective image forming stations, onto the recording material on the recording material supporting member and such superposed toner images are fixed to obtain a recorded image. The present invention is likewise applicable to such image forming apparatus.

(Driving Structure and Operation of Developing Apparatus and Developer Replenishing Apparatus)

Now an explanation will be given on a driving structure of the developing apparatus 4 and the developer replenishing apparatus 50 with reference to FIG. 2.

As already mentioned above, the developing apparatus 4 and the developer replenishing apparatus 50 are similar in the configuration and the operation mode to the prior art shown in FIGS. 4 to 10 so that the foregoing description is applicable thereto, but the developing apparatus 4 and the developer replenishing apparatus 50 are constructed briefly as follows.

Figure 7B:
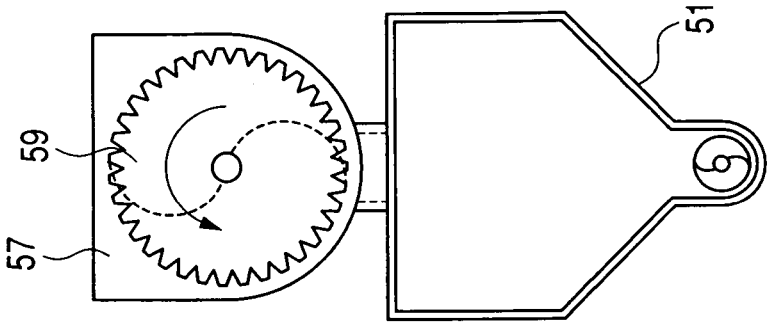
FIGS. 7A and 7B respectively, are views showing a schematic configuration of a developing apparatus and a developer replenishing apparatus.
Figure 7A:
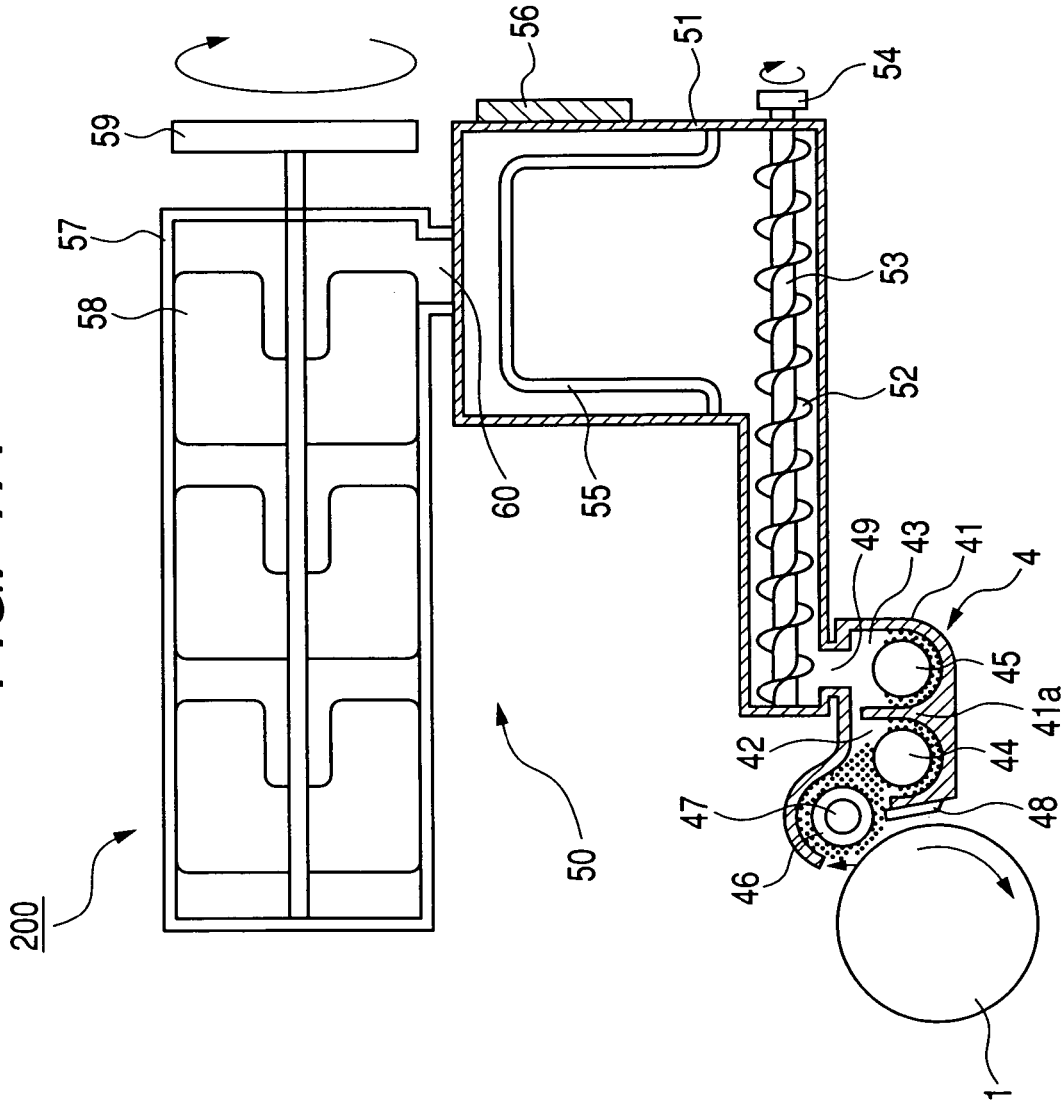
Figure 8:
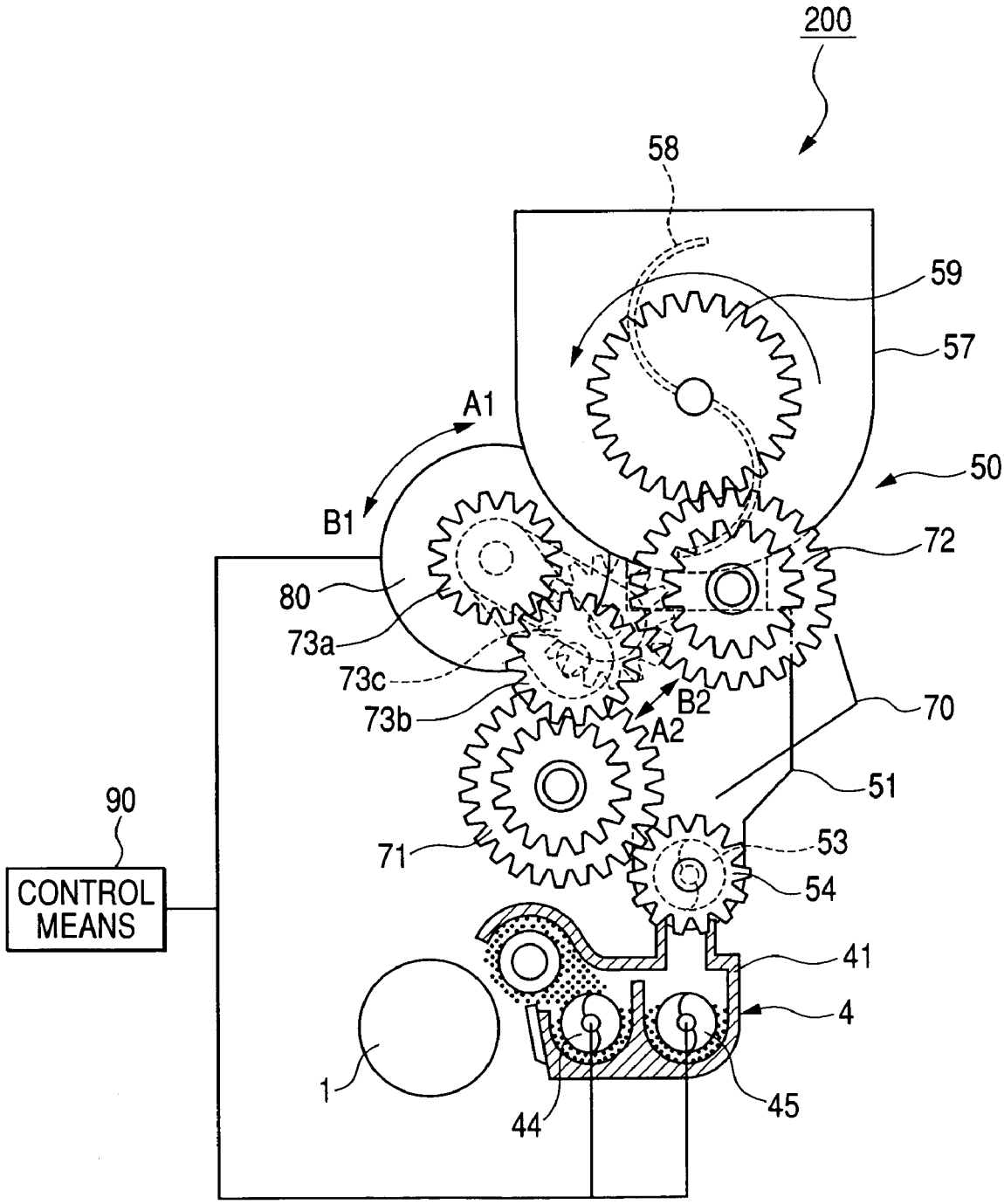
FIG. 8 is a view showing a configuration of a prior driving mechanism for a developer replenishing apparatus and a developing apparatus.

As will be understandable from FIGS. 7 and 8 and from a related description, the developing apparatus 4 is capable, by a developer contained therein, of developing an electrostatic image formed on the photosensitive drum 1 into a visible image.

The developing apparatus 4 is provided with a developing screw 44 and an agitating screw 45 constituting developer agitating means which agitates and carries the developer in the developing apparatus 4. Also the developer replenishing apparatus 50 is provided, as described above, with a toner sub-container 51 constituting a first developer container for storing toner to be replenished to the developing apparatus 4, a replenishing screw 53 constituting first replenishing means for discharging the toner from the toner sub-container 51 and replenishing it to the developing apparatus 4, a main toner container 57 constituting a second developer container storing the toner to be replenished to the toner sub-container 51, and an agitating/carrying member 58 constituting second replenishing means for discharging the toner from the main toner container 57 and replenishing it to the toner sub-container 51.

A driving mechanism 200 for the developer replenishing apparatus 50 is provided with a motor 80 constituting rotation drive means which is capable of transmitting a driving power to the replenishing screw 53 and the agitating/carrying member 58, and a drive gear train 70 constituting rotation transmitting means which is capable of transmitting the rotation of the motor 80 to the replenishing screw 53 and the agitating/carrying member 58.

The drive gear train 70 includes a first drive gear 73*a* at the side of the motor 80 and a second drive gear 73*b* engaging with the first drive gear 73*a*, and the second drive gear 73*b* engages with a first intermediate gear 71 for transmitting the driving power to the replenishing screw 53 and with a second intermediate gear 72 for transmitting the driving power to the agitating/carrying member 58.

The first intermediate gear 71 transmits the driving power to a replenishing screw driving gear 54 constituting drive means for the replenishing gear 53, while the second intermediate gear 72 transmits the driving power to an agitating/carrying member driving gear 59 constituting drive means for the agitating/carrying member 58. Control means 90 controls rotation and stopping of the motor 80. The control means 90 can also control rotation and stopping of the developer agitating means, namely the developing screw 44 and the carrying screw 45, in the developing apparatus 4.

Figure 2:
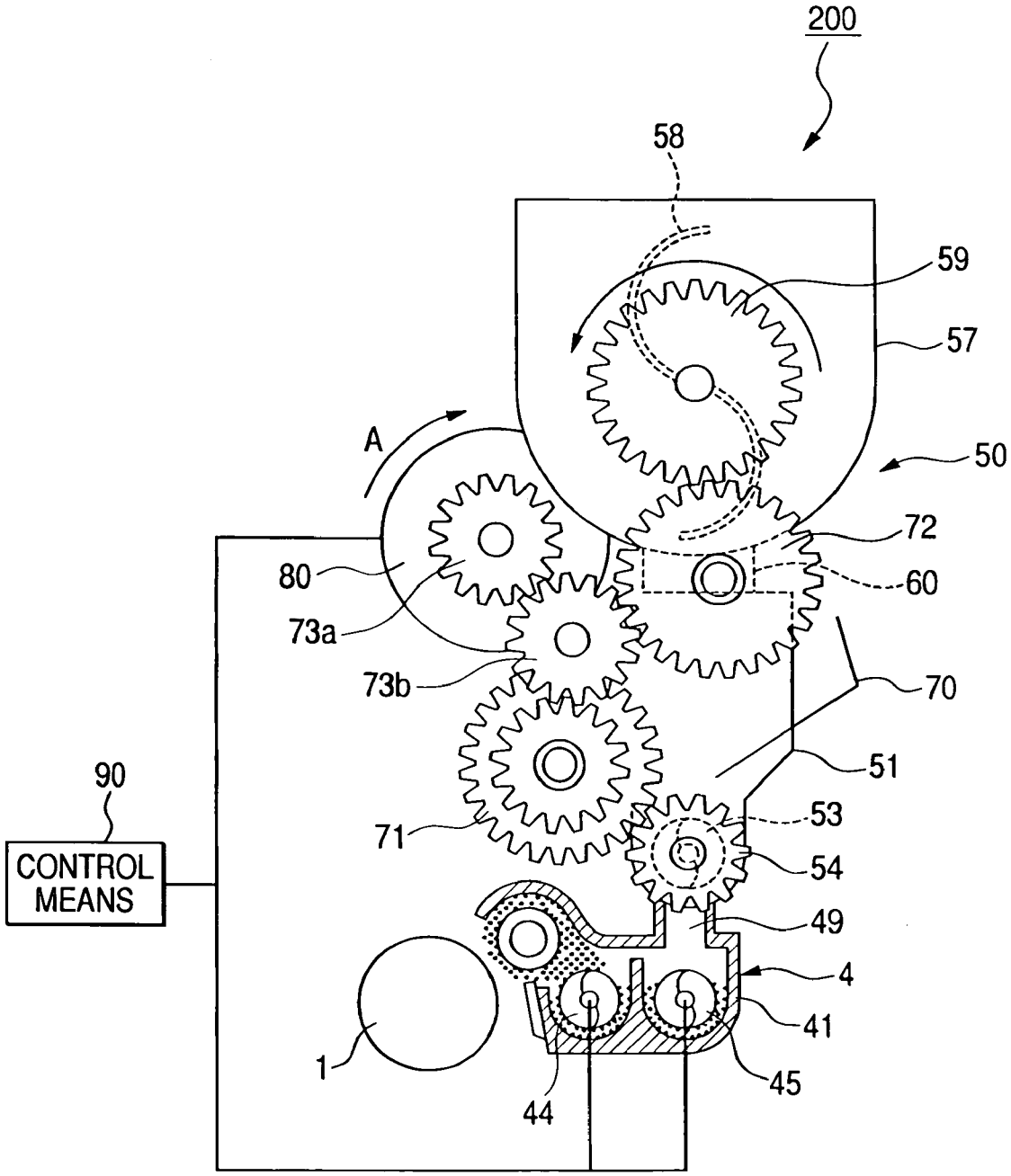
FIG. 2 is a view showing an embodiment of a driving mechanism for a developer replenishing apparatus and a developing apparatus.

In the aforementioned configuration, a rotation of the motor 80 a direction A1 in FIG. 2 causes a simultaneous rotation of the replenishing screw 53 and the agitating/carrying member 58, which are simultaneously stopped when the motor 80 is stopped. In contrast to the prior driving mechanism, the drive gear train 70 is free from a switching mechanism by a lever, a speed varying mechanism or a clutch mechanism, the rotations of the motor 80, the replenishing screw 53 and the agitating/carrying member 58 are always in a proportional relation.

It is thus not possible, in contrast to the prior configuration, to rotate the replenishing screw 53 while the agitating/carrying member 58 is stopped, or to rotate the agitating/carrying member 58 while the replenishing screw 53 is stopped, and only possible to rotate or stop the replenishing screw 53 and the agitating/carrying member 58 at the same time.

Therefore, a gear ratio of the drive gear train, a shape of the agitating/carrying member 58, a pitch of the replenishing screw 53 and a size of the supply aperture 60 from the main toner container 57 to the toner sub-container 51 are so selected, for a rotation angle of A° of the agitating/carrying member 58 (constant A being determined form the gear ratio of the drive gear train) corresponding to a full turn of the replenishing screw 53, that an average replenishing amount (Yg) from the main toner container 57 to the toner sub-container 51 by a rotation of the agitating/carrying member 58 by A° is sufficiently larger than a toner replenishing amount (Xg) from the toner sub-container 51 to the developing apparatus 4 by a rotation of the replenishing screw 53 by 360° (namely a full turn).

Stated differently, in the operation of the driving source, a replenishing amount of the replenishing developer per unit time from the main toner container 57 to the toner sub-container 51 is so selected as to be larger than the replenishing amount of the replenishing developer per unit time from the toner sub-container 51 to the developing apparatus 4.

Figure 3A:
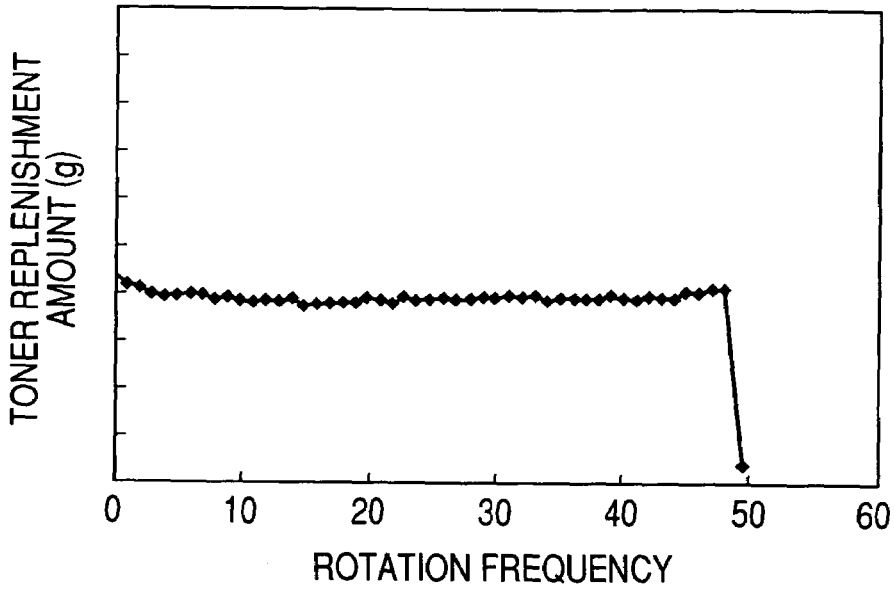
FIG. 3A is a chart showing a relationship between a number of rotations of a replenishing screw and a toner replenishing amount from a toner sub-container to a developing apparatus.

In the following such setting will be explained further. FIG. 3A shows a plotting of the toner amount replenished from the toner sub-container 51 to the developing apparatus 4 in the ordinate, as a function of a number of rotations of the replenishing screw 53 in the abscissa, and the toner of a substantially constant amount is replenished in proportion to the number of rotations, unless the toner amount in the toner sub-container 51 becomes extremely low. A control for obtaining a constant TIC ratio in the developing apparatus can be realized with an improved precision, as explained before.

Figure 3B:
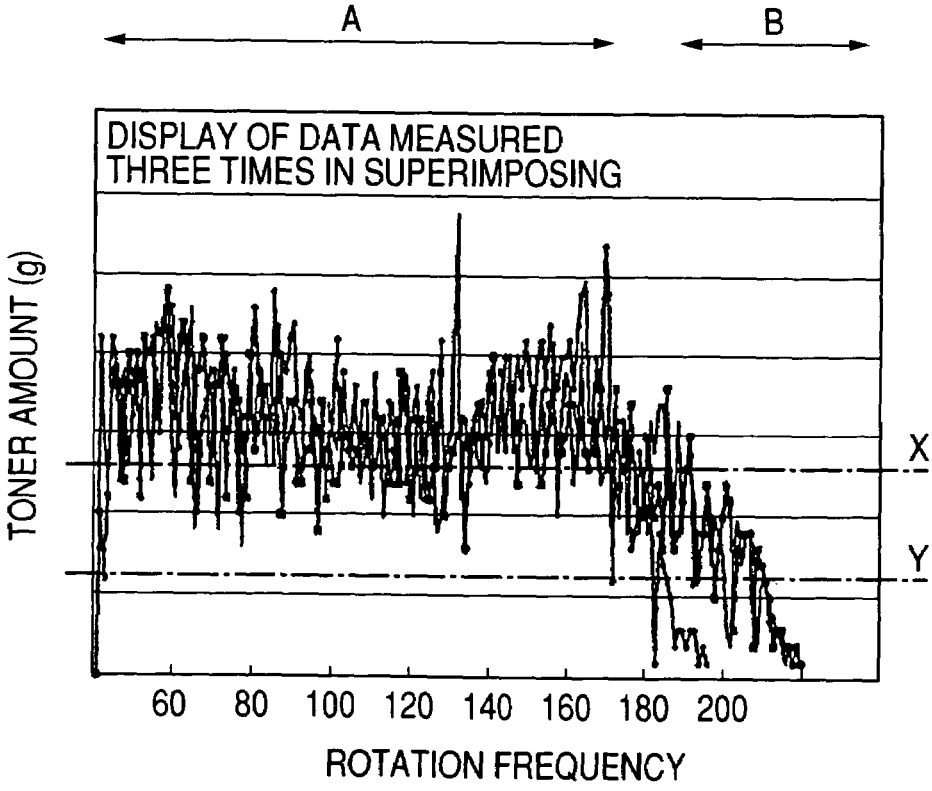
FIG. 3B is a chart showing a relationship between a number of rotations of an agitating/carrying member and a toner replenishing amount from a main toner container.

FIG. 3B shows a plotting of the toner amount discharged from the main toner container 57 in the ordinate, as a function of a number of rotations of the agitating/carrying member 58 in the abscissa. As shown in this chart, the toner amount in the main toner container 57 continues to decrease, so that the discharged toner amount is not constant as a function of the number of rotations. Also the discharge is conducted, instead of a replenishing screw as in the toner sub-container 51, by the agitating/carrying member 58 formed by an elastic member such as a PET sheet, which shows a larger fluctuation in comparison with that in the replenishing screw 53. A very large fluctuation will be observed from the chart showing results of three measurements in superposed form. The number of rotations of the agitating/carrying member 58 and the replenishing screw 53 and the gear ratio determining such numbers are evidently determining such numbers are evidently a factor determining the average replenishing amount (Yg) from the main toner container 57 to the toner sub- container 51, but another important factor is a shape of the agitating/carrying member 58.

In either of the experiments plotted in FIGS. 3A and 3B, the toner amount discharged from the main toner container 57 eventually becomes almost zero. This is because the agitating/carrying member 58 is so designed as to be capable of discharging all the toner by or beyond a predetermined number of rotations, and such situation can be realized by suitably selecting a radial length, a number, a thickness and a rigidity of the agitating/carrying member 58 in such a manner that the external periphery thereof is in a sliding contact with a sufficient pressure on the internal surface of the main toner container 57.

As an example, the agitating/carrying member 58 employed in these experiments had a radial length of 39 mm with respect to an internal radius of the main toner container 57, was provided in two units with a mutually opposed relationship with an angle of 180°, was constituted of a PET sheet of a thickness of 0.188 mm and had a longitudinal length substantially equal to that of the main toner container 57. Also, as the agitating/carrying member 58 tries to feed the toner even if the toner sub-container 51 is filled with the toner, a junction between the toner sub-container 51 and the main toner container 57 requires a seal capable of withstanding such a situation.

An important factor determining the average replenishing amount (Yg) of the toner from the main toner container 57 to the toner sub-container 51 is a shape of the toner discharge aperture 60, and a larger or smaller aperture evidently provides a larger or smaller replenishing amount.

In addition to the foregoing, a larger aperture stimulates a toner extruding pressure of the agitating/carrying member 58 to be easily transmitted to the interior of the toner sub-container 51 thereby leading to a drawback that the toner weight per unit volume increases in the toner sub-container 51, and a smaller aperture leads to a drawback that all the toner in the main toner container 57 cannot be discharged by the agitating/carrying member 58.

In addition to the size of the discharge aperture 60, its position higher than a lowest plane of the main toner container 57 tends to generate a drawback as in a small discharge aperture 60, and a position close to the lowest plane of the main toner container 57 tends to generate a drawback as in a large discharge aperture 60. Results shown in FIGS. 3A and 3B can be obtained by setting the discharge aperture at a suitable size and a suitable height, in consideration of such tendencies.

For the agitating/carrying member 58 of the main toner container 57 and the replenishing screw 53 of the toner sub-container 51, the selection of the gear ratio of the drive gear train, the pitch of the replenishing screw 53, the size of the supply aperture 60 from the main toner container 57 to the toner sub-container 51 etc. in such a manner that the average toner replenishing amount (Yg) from the main toner container 57 to the toner sub-container 51 by a rotation of the agitating/carrying member 58 by A° is sufficiently larger than the toner replenishing amount (Xg) from the toner sub-container 51 to the developing apparatus 4 by a full rotation of the replenishing screw 53 means that "when the replenishing screw 53 and the agitating/carrying member 58 are rotated simultaneously, an average toner replenishing amount from the main toner container 57 to the toner sub-container 51 is sufficiently larger than a toner replenishing amount from the toner sub-container 51 to the developing apparatus 4".

For example, assuming that X in FIG. 3B represents an average toner replenishing amount from the main toner container 57 to the toner sub-container 51 and Y represents the predetermined replenishing amount of the replenishing screw 53, Y can be considered to be sufficiently larger than X. Also in an illustrated range A, the toner replenishing amount from the main toner container 57 to the toner sub-container 51 is larger than the toner replenishing amount from the toner sub-container 51 to the developing apparatus 4, while, in a range B, the toner replenishing amount from the toner sub-container 51 to the developing apparatus 4 is larger than the toner replenishing amount from the main toner container 57 to the toner sub-container 51.

In the illustrated range A, there results a phenomenon that the agitating/carrying member 58 tries to extrude the toner toward the toner sub-container 51 in spite of the abundant toner present in the toner sub-container 51. The agitating/carrying member 58, being constituted for example of a PET sheet material and being deformable, does not apply an excessive pressure on the toner in the toner sub-container 51 as long as the rotation angle of the agitating/carrying member 58 does not exceed a certain limit. However, in case the rotation angle of the agitating/carrying member 58 exceeds a certain limit, an excessive pressure is applied on the toner in the toner sub-container 51 to excessively increase a toner weight per unit volume in the toner sub-container 51, thereby perturbing the precision of the replenishing amount whereby the T/C ratio in the developing apparatus 4 cannot be controlled and the image quality of the image forming apparatus may be deteriorated.

Figure 4A:
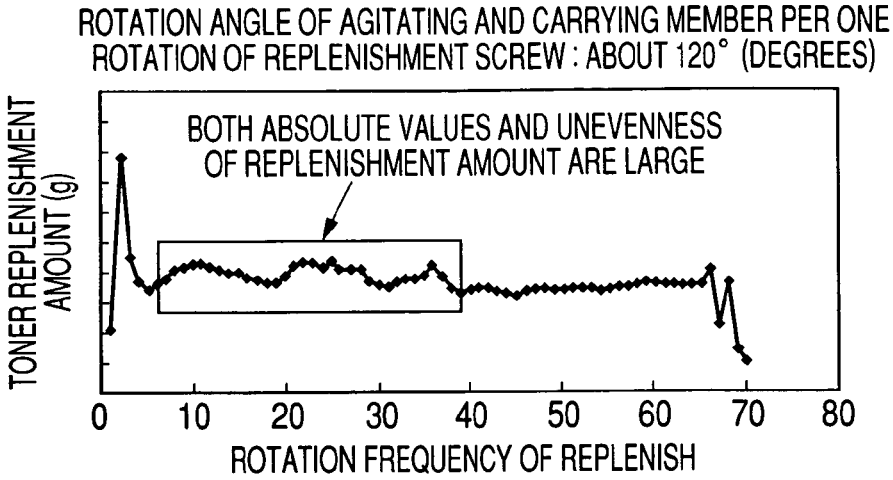
FIGS. 4A, 4B and 4C are charts showing a relationship between a number of rotations of the replenishing screw and a toner replenishing amount respectively when the agitating/carrying member rotates by about 120°, 60° or 30° per a turn of the replenishing screw.
Figure 4B:
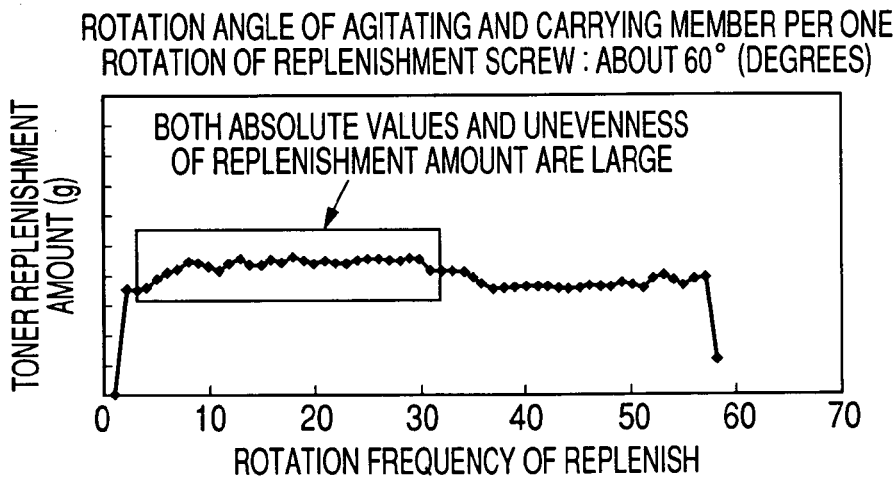
Figure 4C:
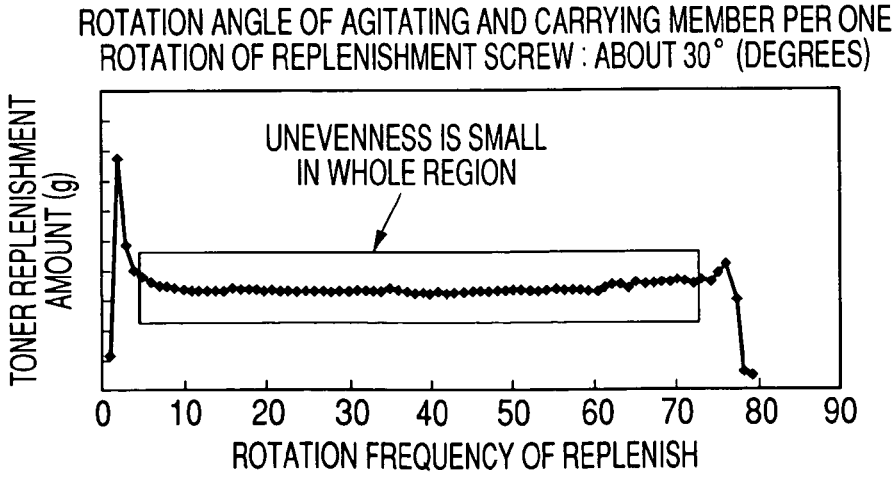

In FIGS. 4A, 4B and 4C show actual experimental results by plotting a toner amount replenished each time in the ordinate, as a function of a number of rotations of the replenishing screw 53 in the abscissa, respectively corresponding to a rotation angle of the rotation angle of the agitating/carrying member 58 of about 120° , 60° and 30° per a turn of the replenishing screw 53.

It can be observed from the charts that, for a rotation angle of the agitating/carrying member 58 equal to or larger than 60°, the toner weight per unit volume in the toner sub-container 51 becomes excessively large to perturb the precision of the replenishing amount, but a rotation angle of about 30° can stabilize the T/C ratio control in the developing apparatus 4 thereby stabilizing the image quality of the image forming apparatus.

On the other hand, in the range B in FIG. 3, since the toner replenishing amount from the toner sub-container 51 to the developing apparatus 4 is larger than the toner replenishing amount from the main toner container 57 to the toner sub-container 51, the toner amount in the toner sub-container 51 gradually decreases and such decrease becomes rapidly steeper as the toner in the main toner container 57 is exhausted. When the toner amount in the toner sub-container 51 becomes extremely small with a surface thereof lowered close to the replenishing screw 53, the toner replenishing amount per rotation of the replenishing screw 53 naturally decreases.

Therefore, in case the rotation angle of the agitating/carrying member 58 is at least a certain level, the toner level in the toner sub-container 51 does not decrease to the vicinity of the replenishing screw 53 until the toner in the main toner container 57 is exhausted, but, in case the rotation angle of the agitating/carrying member 58 is less than a certain level, the toner level in the toner sub-container 51 is lowered to the vicinity of the replenishing screw 53 before the toner in the main toner container 57 is exhausted, whereby the replenishing amount decreases to perturb the replenishing precision and the T/C ratio in the developing apparatus 4 cannot be controlled to deteriorate the image quality of the image forming apparatus.

Figure 5A:
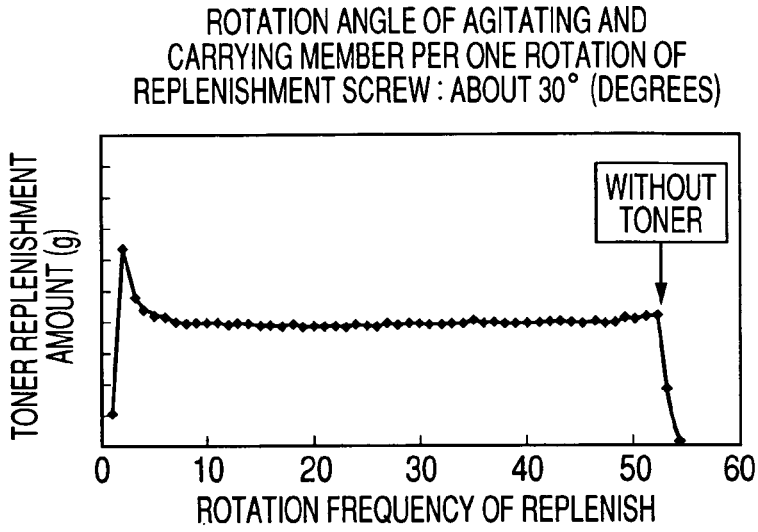
FIGS. 5A, 5B and 5C are charts showing a relationship between a rotation number of the replenishing screw and a toner replenishing amount respectively when the agitating/carrying member rotates by about 30°, 20° or 10° per a turn of the replenishing screw.
Figure 5B:
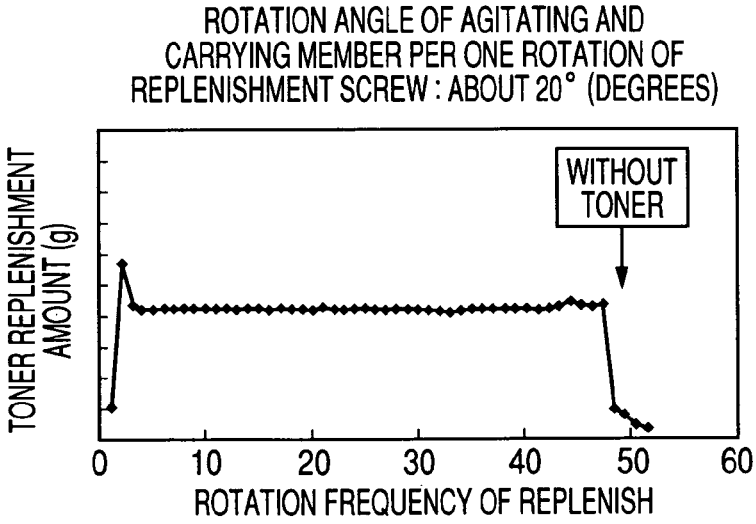
Figure 5C:
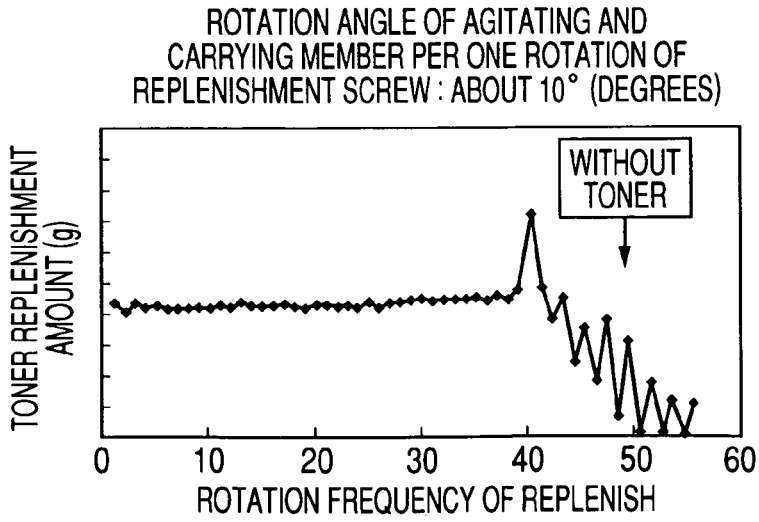

In FIGS. 5A, 5B and 5C show actual experimental results by plotting a toner amount replenished each time in the ordinate, as a function of a number of rotations of the replenishing screw 53 in the abscissa, particularly about a state where the toner is exhausted in the main toner container 57, respectively corresponding to a rotation angle of the rotation angle of the agitating/carrying member 58 of about 30°, 20° and 10° per a turn of the replenishing screw 53.

It can be observed from the charts that, with a rotation angle of the agitating/carrying member 58 equal to or less than 20°, the toner level in the toner sub-container 51 is lowered almost to the vicinity of the replenishing screw 53 before the toner is exhausted in the main toner container 57, thereby decreasing the replenishing amount and perturbing the replenishing precision, but a rotation angle of about 30° can stabilize the T/C ratio control in the developing apparatus, thereby attaining a stable image quality in the image forming apparatus.

As explained in the foregoing, a gear ratio of the driving gear train, a pitch of the replenishing screw 53, a size of the supply aperture 60 from the main toner container 57 to the toner sub-container 51 etc. can be selected in such a manner that a toner replenishing amount from the main toner container 57 to the toner sub-container 51 by the rotation of the agitating/carrying member 58 to a toner replenishing amount from the toner sub-container 51 to the developing apparatus by the rotation of the replenishing screw 53 satisfies following conditions 1 and 2.

Condition 1:

A proportion of the rotation angle of the agitating/carrying member 58 is not so excessively large as to apply an excessive pressure to the toner in the toner sub-container 51, thereby increasing the toner weight per unit volume in the toner sub-container 51 and perturbing the precision of the replenishing amount.

Condition 2:

A proportion of the rotation angle of the agitating/carrying member 58 is not so excessively small as to lower the toner level in the toner sub-container 51 to the vicinity of the replenishing screw 53 before the toner in the main toner container 57 is exhausted, thereby decreasing the toner replenishing amount and perturbing the precision of the replenishing amount.

Values of the rotation angle shown in FIGS. 4 and 5 are merely exemplary, and values different from such example may also be selected by suitably selecting the gear ratio of the driving gear train, the pitch of the replenishing screw 53, the size of the supply aperture 60 from the main toner container 57 to the toner sub-container 51.

On the other hand, a setting satisfying the aforementioned conditions 1 and 2 is not necessarily always possible. For example, the conditions 1 and 2 cannot be satisfied at the same time in case the main toner container 57 has a large volume and the toner amount discharged from the main toner container 57 to the toner sub-container 51 has an extremely large range between maximum and minimum values with respect to the number of rotations. In general, the setting is easier when the main toner container 57 has a small volume and the toner amount discharged from the main toner container 57 to the toner sub-container 51 has a small range between maximum and minimum values with respect to the number of rotations.

Also timings of start and stopping of the replenishing screw 53 are restricted, as in the prior technology, during the rotation of the agitating means 44, 45 of the developing apparatus, and the control means 90 executes the control in such a manner that the replenishing screw 53 starts rotation after the rotation of the agitating means 44, 45 of the developing apparatus 4 is started, and that the agitating means 44, 45 of the developing apparatus 4 is stopped after the replenishing screw 53 is stopped.

As explained in the foregoing, even with a configuration in which the driving gear train 70 does not include a lever switching mechanism or a clutch mechanism and the motor 80 is connected directly to the replenishing screw 53 and to the agitating/carrying member 58 by the gears and can only rotate or stop the replenishing screw 53 and the agitating/carrying member 58 at the same time, the aforementioned setting satisfying the aforementioned conditions 1 and 2 can simplify the mechanism, with a further simplified configuration than in the foregoing embodiment, in comparison with the prior art, whereby a simplification, a size reduction and a cost reduction of the image forming apparatus can be realized.

Figure 6:
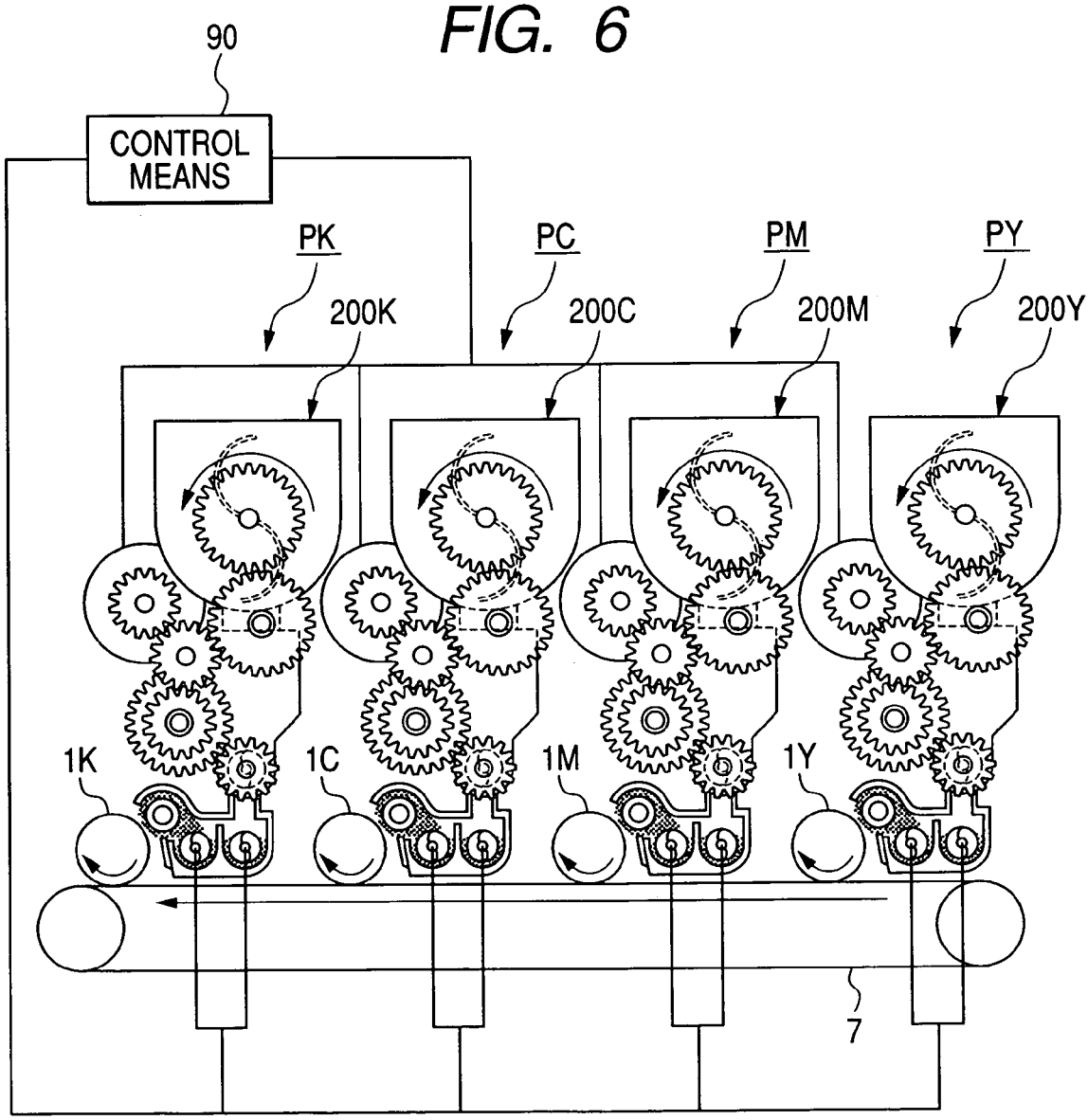
FIG. 6 is a view showing an embodiment of a driving mechanism for a developer replenishing apparatus and a developing replenishing in the image forming apparatus shown in FIG. 1.

FIG. 6 shows an embodiment in which, in a tandem full-color image forming apparatus shown in FIG. 1, the driving mechanism 200 (200Y, 200M, 200C, 200K) explained in FIG. 2 is applied to each image forming station P (PY, PM, PC, PK).

Also this embodiment can realize, as explained above, a simplification, a size reduction and a cost reduction of the image forming apparatus in comparison with the prior art.

Also in the present embodiment, the timings of start and stopping of the replenishing screw 53 are restricted, as in the prior technology, during the rotation of the agitating/carrying member 58 of the developing apparatus, and the control means 90 executes the control in such a manner, as in the prior art, that the replenishing screw 53 starts rotation after the rotation of the agitating means 44, 45 of the developing apparatus 4 is started, and that the agitating means 44, 45 of the developing apparatus 4 is stopped after the replenishing screw 53 is stopped.

Other Embodiments

The present invention has been explained by embodiments thereof, but it is to be understood that the present invention is not limited to such embodiments.

For example, in the embodiment 1, the first replenishing means which replenishes the toner from the toner sub-container (first developer container) 51 to the developing apparatus 4 is constituted of a screw member having a spiral carrying portion on a rotary axis (replenishing screw 53), and the second replenishing means which replenishes the toner from the main toner container (second developer container) 57 to the toner sub-container 51 is constituted of a blade-shaped sheet material rotating about a rotary axis (agitating/carrying member 58), but the present invention is not limited to such forms.

The first replenishing means can be any available means that can carry and replenish the toner of a required amount, preferably quantitatively, to the developing apparatus 4. Also the second replenishing means can be any available means that can carry the developer from the second developer container toward the supply aperture for developer supply to the first developer container. For example, there can be employed a system of rotating a container itself, having a spiral projection on the internal wall thereof.

Also in the embodiment 1, the image forming apparatus is assumed to a four-unit tandem full-color image forming apparatus, but the image forming station (namely developing apparatus and developer replenishing apparatus) may be provided in a larger number or a smaller number. The present invention is likewise applicable to an image forming apparatus provided with a single image bearing member, and a developing apparatus and a developer replenishing apparatus corresponding thereto.

Also there can be employed an image forming apparatus having plural developing apparatuses for a single image bearing member and a developer replenishing apparatus for each developing apparatus. For example, as already known to those skilled in the art, there is known an image forming apparatus in which electrostatic images formed in succession on a single image bearing member are developed in succession with developing apparatuses utilizing developers of different colors, and such developer images are transferred successively or collectively onto a recording material, or superposed by successive transfers onto an intermediate transfer member and then transferred onto a recording material, and then fixed to obtain a color image. The present invention is likewise applicable also to the image forming apparatus of such system.

Also in the foregoing embodiment, it is assumed that toner is replenished as a replenishing developer form the developer replenishing apparatus 50 to the developing apparatus 4, but the present invention is not limited to such case. In a developing apparatus 4 utilizing a two-component developing method, carrier may also be replenished in addition to the toner. The present invention is likewise applicable to a case where toner and carrier are replenished as the replenishing developer.

Furthermore, the present invention is also likewise applicable to a case of employing, as the developer, a one-component developer constituted substantially of toner only.

This application claims priority from Japanese Patent Application No. 2004-329460 filed Nov. 12, 2004, which is hereby incorporated by reference herein.

What is claimed is:

1. A developer replenishing apparatus for replenishing a replenishing developer to a developing apparatus for developing an electrostatic image, the replenishing apparatus comprising:

a first developer container for containing the replenishing developer to be replenished to the developing apparatus;

a second developer container for containing the replenishing developer to be replenished to the first developer container;

a first replenishing mechanism for replenishing the replenishing developer in the first developer container to the developing apparatus;

a second replenishing mechanism for replenishing the replenishing developer in the second developer container to the first developer container; and a driving source capable of simultaneously driving the first replenishing mechanism and the second replenishing mechanism, wherein, at an operated state of the driving source, a replenishing amount of the replenishing developer per unit of time from the second developer container to the first developer container is larger than a replenishing amount of the replenishing developer per unit of time from the first developer container to the developing apparatus.

2. A developer replenishing apparatus according to claim 1, wherein the first replenishing mechanism includes a first replenishing member for replenishing the developer by a rotation, the second replenishing mechanism includes a second replenishing member for replenishing the developer by a rotation, the driving source executes a rotary motion to drive the first replenishing member and the second replenishing member in rotation, and the driving source, the first replenishing member and the second replenishing member have substantially proportional rotation speeds.

3. A developer replenishing apparatus according to claim 2, further comprising:

a developer agitating mechanism for agitating the developer in the developing apparatus; and control means for controlling rotation and stopping of the driving source and rotation and stopping of the developer agitating mechanism.

4. A developer replenishing apparatus according to claim 3, wherein the control means starts a driving power transmission to the first replenishing mechanism after the operation of the developer agitating mechanism is started, and terminates the driving power transmission to the first replenishing mechanism before the operation of the developer agitating mechanism is stopped.

5. A developer replenishing apparatus according to claim 2, wherein for a rotation angle of A° of the second replenishing member corresponding to a full turn of the first replenishing member, an average developer replenishing amount (Yg) from the second developer container to the first developer container by a rotation of the sheet member by the angle A° is sufficiently larger than a developer replenishing amount (Xg) from the first developer container to the developing apparatus by a full turn of the replenishing member.

* * * * *

UNITED STATES PATENT AND TRADEMARK OFFICE

CERTIFICATE OF CORRECTION

PATENT NO. : 7,248,825 B2
APPLICATION NO. : 11/258932
DATED : July 24, 2007
INVENTOR(S) : Hitoshi Nishitani et al.

It is certified that error appears in the above-identified patent and that said Letters Patent is hereby corrected as shown below:

COLUMN 16:

Line 17, "the first developer container; and" should read --the first developer container by rotating a deformable sheet member rotatably disposed in said second developer container; and--.

Line 29, "includes a first" should read --includes a--.

Line 31, "a rotation" should read --rotation--.

Lines 32-34, "the second replenishing mechanism includes a second replenishing member for replenishing the developer by a rotation," should be deleted.

Line 36, "first" should be deleted.

Line 36, "second replenishing" should read --sheet--.

Line 38, "driving source, the first" should be deleted.

Line 39, "second replenishing" should read --sheet--.

Lines 39-40, "have substantially proportional" should read --are rotated so that respective--.

Line 40, "speeds." should read --speeds thereof are proportional.--.

Line 58, "first" should be deleted.

Signed and Sealed this

Twenty-ninth Day of April, 2008

JON W. DUDAS
*Director of the United States Patent and Trademark Office*